US006792702B2

(12) United States Patent
Borsoi et al.

(10) Patent No.: US 6,792,702 B2
(45) Date of Patent: Sep. 21, 2004

(54) INNER TIGHTENING MECHANISM FOR FOOTWEAR AND FOOTWARE INCORPORATING SUCH TIGHTENING MECHANISM

(75) Inventors: Bruno Borsoi, Victorio Veneto (IT); Fabio Basso, Asolo (IT)

(73) Assignee: Salomon S.A., Metz-Tessy (FR)

( * ) Notice: Subject to any disclaimer, the term of this patent is extended or adjusted under 35 U.S.C. 154(b) by 0 days.

(21) Appl. No.: 09/973,035

(22) Filed: Oct. 10, 2001

(65) Prior Publication Data

US 2002/0129518 A1 Sep. 19, 2002

(30) Foreign Application Priority Data

Oct. 10, 2000 (FR) ..... 00 13185

(51) Int. Cl.[7] ..... A43B 5/04; A43B 7/14; A43B 23/28

(52) U.S. Cl. ..... 36/117.6; 36/88; 36/117.9; 36/58.5

(58) Field of Search ..... 36/88, 96, 114, 36/117.9, 117.6, 117.7, 72 R, 51, 58.5, 50.5

(56) References Cited

U.S. PATENT DOCUMENTS

| | | | | | |
|---|---|---|---|---|---|
| 1,650,000 | A | * | 11/1927 | Young | 36/58.5 |
| 3,235,981 | A | * | 2/1966 | Kloss | 36/58.5 |
| 4,030,215 | A | | 6/1977 | Vogel | |
| 4,160,332 | A | * | 7/1979 | Salomon | 36/117.7 |
| 4,513,520 | A | | 4/1985 | Koch | |
| 4,660,303 | A | * | 4/1987 | Courvoisier et al. | 36/117.9 |
| 5,269,078 | A | * | 12/1993 | Cochrane | 36/50.1 |
| 5,832,632 | A | * | 11/1998 | Bergeron | 36/58.5 |

FOREIGN PATENT DOCUMENTS

| | | | | |
|---|---|---|---|---|
| CH | 408706 | | 2/1966 | |
| EP | 0134778 | * | 7/1984 | A43B/5/04 |
| EP | 0146502 | | 6/1985 | |
| EP | 0259896 | | 3/1988 | |
| FR | 2615074 A1 | * | 11/1988 | A43B/5/14 |

* cited by examiner

*Primary Examiner*—Anthony D. Stashick
(74) *Attorney, Agent, or Firm*—Greenblum & Bernstein, P.L.C.

(57) ABSTRACT

An inner tightening mechanism adapted to equip an article of footwear having a flexible or semi-rigid upper, and an article of footwear incorporating such tightening mechanism. The inner tightening mechanism includes a retention band that is connected to the inner surface of the upper by at least two anchoring points fixed on the lateral and medial sides, respectively, of the flexion in the direction of the heel, and at least one anchoring point is positioned substantially above the sole.

54 Claims, 8 Drawing Sheets

27
7
0'
0
S1
10
100b
12
100
CH'
S2
1
CH

INNER TIGHTENING MECHANISM FOR FOOTWEAR AND FOOTWARE INCORPORATING SUCH TIGHTENING MECHANISM

BACKGROUND OF THE INVENTION

1. Field of the Invention

The present invention relates to an inner tightening mechanism adapted to equip an article of footwear that can be used, particularly, but in a non-limiting manner, for sporting activities.

The articles of footwear thus equipped are intended especially for snowboarding, mounting hiking, in-line roller skating, and ice skating, etc., i.e., for those sports that require the foot to be properly held.

2. Description of Background and Relevant Information

In the prior art, there are numerous inner tightening systems that hold the foot in the flexion fold area, in the direction of the heel of the boot. However, these systems, in particular that which is described in the document EP 146 502, are associated with boots having a rigid upper, such as alpine ski boots which are constituted of a plastic shell. The inner tightening is connected to the shell in the area where the shell and of the sole are joined in order to surround the foot over a maximum portion of the foot perimeter. This type of internal tightening manages the foot volume independently of the shell and simultaneously holds the foot laterally and axially.

Thus, with a system of this type, a dimensional variation in one direction results in a clearance in the retention in the other direction. This dimensional variation can be caused especially by the compression of the inner shoe which is arranged beneath the tightening system.

The document U.S. Pat. No. 4,513,520 describes a boot having a rigid upper, which is equipped with an inner tightening system arranged in the area of the foot flexion fold, and which is kept tensioned by a hooking on the top of the upper of the inner shoe of the boot. The system surrounds the inner shoe in a manner that is completely independent of the boot upper. Thus, the system presses the inner shoe against the foot. However, it does not improve the overall precision of the boot, because the tightening system only creates a free space between the inner shoe and the boot upper.

Moreover, the present devices apply to ski boots, such as alpine ski boots where the separations of the heel are generated by forward bending movements of the ankle-knee assembly.

SUMMARY OF THE INVENTION

Therefore, one of the objects of the present invention is to propose an inner tightening mechanism adapted to equip an article of footwear having a flexible or semi-rigid upper, and partially surrounding the foot in the area of the flexion fold, in the direction of the heel, which provides an efficient retention of the foot.

Another object of the invention is to propose an inner tightening mechanism which surrounds the foot comfortably while respecting the specific forces applied on the article of footwear, especially during snowboarding.

To achieve these objects, the inner tightening mechanism includes a retention band that is connected to the inner surface of the upper of the article of footwear by at least two anchoring points fixed on the lateral and medial sides, respectively, of the upper. To optimize the retention of the foot by taking advantage of the flexibility of the upper, at least one anchoring point is positioned substantially above the sole, especially in the central portion of the axial length comprised between the foot and the base of the heel of the foot. The tightening is ensured by a sliding return that is associated with an anchoring point. In addition, a retention band, which is fixed at one of its ends to the other anchoring point, passes in the sliding return by covering the foot. The retention band includes an appropriate attachment, which is located between the other end of the band and the sliding return, and which makes it possible to maintain the tension in the tightening mechanism by becoming attached to the upper of an inner shoe or boot with which the article of footwear is equipped.

In a first embodiment, the article of footwear, which is equipped with the inner tightening mechanism, includes an inner shoe or boot that is arranged beneath the present mechanism.

In a second embodiment, the inner tightening mechanism is in close contact with the foot.

BRIEF DESCRIPTION OF THE DRAWINGS

The invention will be better understood and other advantages thereof will become apparent from the description, with reference to the annexed drawings. The description illustrates, by way of non-limiting examples, certain preferred embodiments, in which.

DETAILED DESCRIPTION OF THE INVENTION

In FIGS. 1–5, the article of footwear CH shown is a boot having a flexible or semi-rigid upper adapted for snowboarding. A boot having a semi-rigid upper here is a boot with a flexible upper including a more or less large proportion of rigid reinforcements positioned either within or outside the upper O, and adapted to better transmit the forces and supports, but also to protect from impacts.

Figure 1:
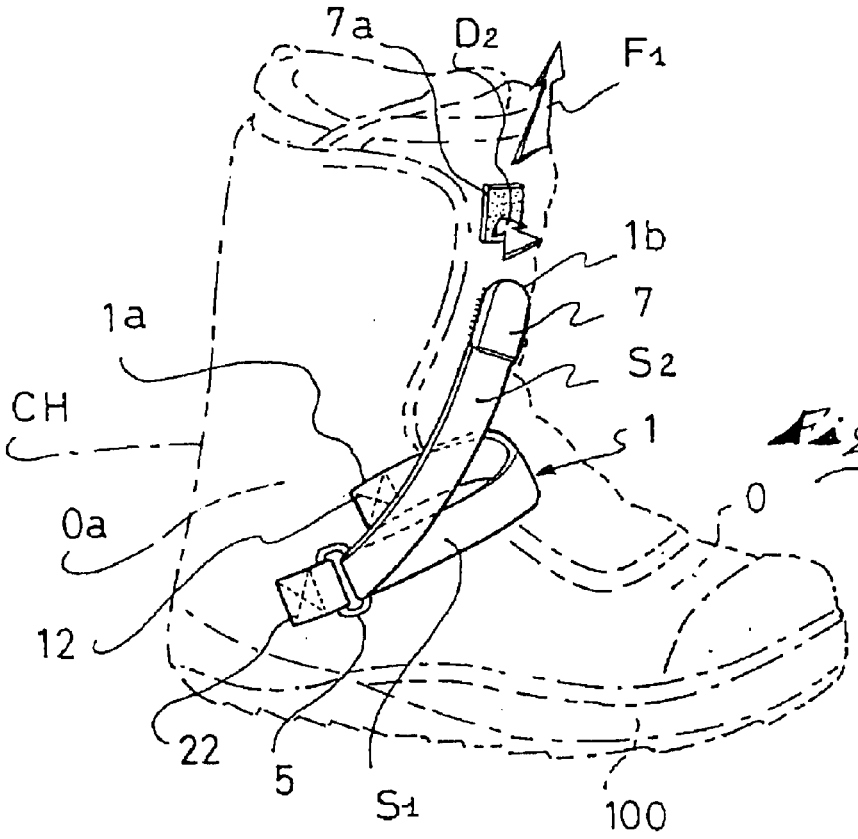
FIG. 1 schematically shows a perspective front view of the inner tightening mechanism according to the first embodiment.

In FIG. 1, the article of footwear CH is shown in broken lines in order to better illustrate the inner tightening mechanism. The article of footwear CH includes a flexible or semi-rigid upper O which is mounted on a sole 100. The tightening mechanism, which is arranged within the upper O, includes a retention band 1 that is connected to the inner surface Oa of the upper O by at least two anchoring points 12, 22, fixed on the lateral and medial sides, respectively, of the upper O . This retention band 1 partially surrounds the foot, between the two anchoring points 12, 22, in the area of the flexion fold of the foot, and in the direction of the heel. Once the retention band 1 is tensioned, the portion S1 of the band 1, which is located between the anchoring points 12 and 22, firmly retains the foot in the article of footwear CH by pressing the foot, in the area of the flexion fold, against the rear of the inner surface Oa of the upper O and the sole 100.

The tensioning of the retention band 1 is made possible due to the fact that the anchoring point 22 includes a sliding return 5 in which the retention band 1 passes, The retention band 1, which is fixed at its end 1*a* to the inner surface 1*a* of the upper O, by means of the anchoring point 12, surrounds the foot in the area of the portion S1. Then, the retention band 1 passes in the sliding return 5 and defines a portion S2 of the band 1, which is comprised between the sliding return 5 and the other end 1*b* of the retention band 1. Thus, the user of the article of footwear CH grabs the portion S2 of the retention band 1 with his hand, which is accessible because it is close to the top of the upper O, and pulls the portion S2 upward by applying a force F1. This action F1, due to the sliding of the band 1 in the return 5, makes it possible to reduce the length of the portion S1 of the retention band 1, and to tension the band 1. However, as the anchoring points 12, 22, are firmly fixed on the upper O, the shortening of the portion S1 creates a reduction in the distance between the flexion fold and the heel of the foot by making it possible to retain the foot in the area of the ankle.

The tension in the tightening mechanism, and therefore in the retention band 1 is maintained by an appropriate fastening arrangement 7 which is advantageously arranged in the vicinity of the end 1*b* of the retention band 1. The fastening arrangement 7 is adapted to ensure a removable fixing of the retention band 1 on a possible inner shoe or boot to which another fastening arrangement 7*a* is attached. The fastening arrangement 7 can advantageously be adapted to ensure an adjustment of the position of the fastening arrangement 7 in relation to the fastening arrangement 7*a*. Thus, advantageously but in a non-limiting manner, the fastening arrangement 7 can be of the self-gripping type. To maintain the tension in the tightening mechanism, the user then exerts a substantially horizontal displacement D2 which brings the top of the arrangement 7 against the complementary arrangement 7*a*.

Of course, the user can combine the two actions of tensioning and of locking the tension in a single movement.

Figure 2:
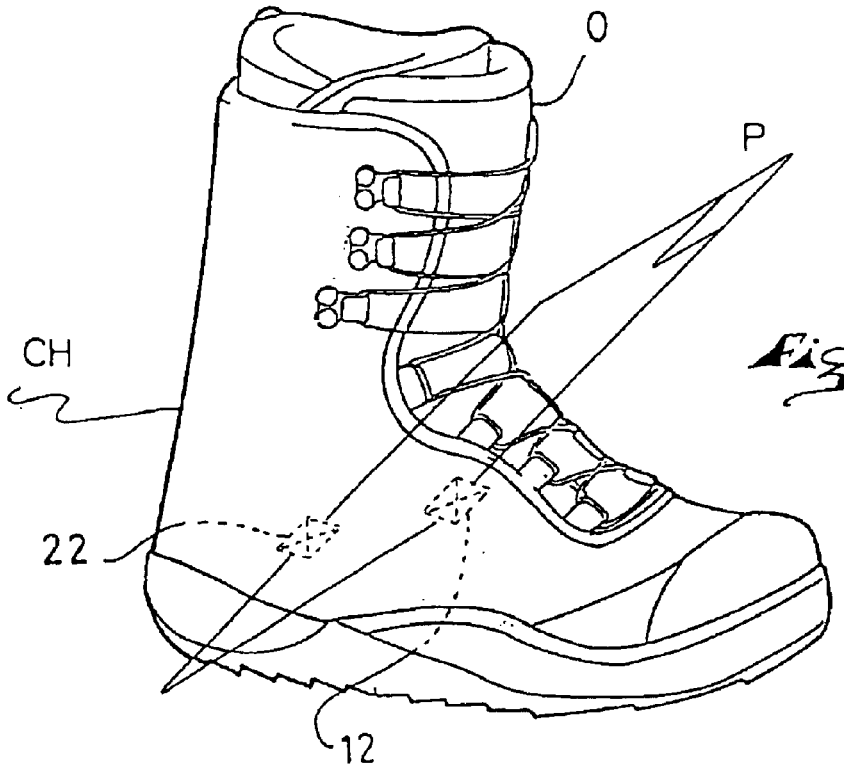
FIG. 2 schematically shows a perspective front and top view of the article of footwear equipped internally with the tightening mechanism according to the first embodiment.

FIG. 2 shows the article of footwear CH on which is referenced a plane P along which the portion S1 of the retention band 1 is positioned. As the tightening mechanism is internal to the article of footwear CH, the latter is not shown in FIG. 2. Only the anchoring points 12, 22 are shown in broken lines. The plane P passes through the two anchoring points 12, 22, and substantially through the flexion fold of the foot. In the embodiment shown, the plane P is a transverse plane with respect to the article of footwear CH. This means that the anchoring points are substantially symmetrical on the upper O. Of course, to take into account the asymmetry of the ankle, especially in the area of the malleoli, the plane P can be a non-transverse plane.

Figure 3:
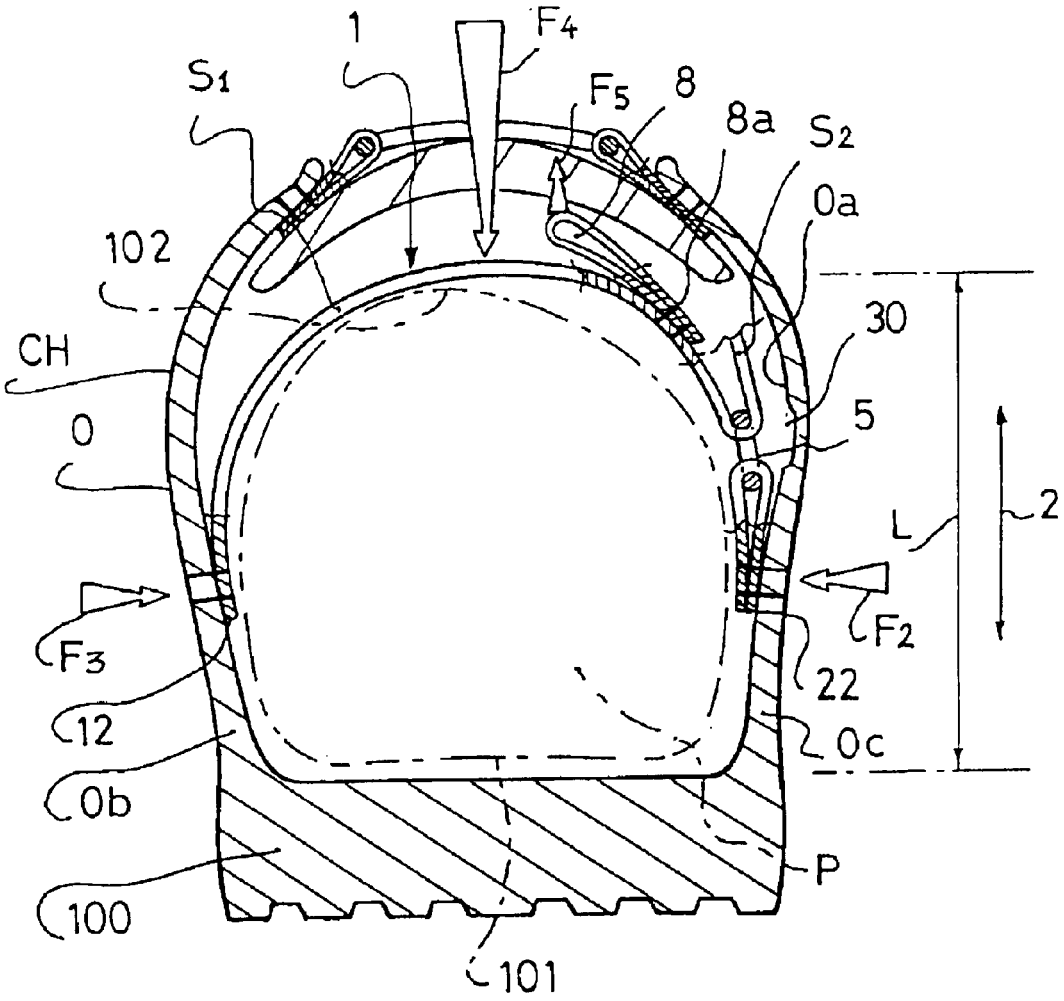
FIG. 3 schematically shows a cross-section of the article of footwear and of the inner tightening mechanism according to the first embodiment, along a cross-sectional plane referenced in FIG. 2.

FIG. 3 shows a cross-section of the article footwear CH shown in FIG. 1 along the plane P referenced in FIG. 2. The portion S2 of the retention band 1 is truncated in the drawing since it is not located in the cross-sectional plane P. The inner tightening mechanism includes at least one anchoring point 12, 22 which is positioned substantially above the sole 100. This arrangement makes it possible to use the flexibility of the upper O for the lateral retention of the foot P. The anchoring point 12, 22 can advantageously be positioned on the central portion 2 of the flexion fold-heel line L. This line L is defined as being the line connecting the flexion fold 102 to the heel 101 of the foot P. In addition, the anchoring points 12, 22 can advantageously be obtained by stitching running through the flexible or semi-rigid upper O.

In the preferred embodiment shown in FIG. 3, the two anchoring points 12, 22 are arranged above the sole 100 and substantially in the central portion 2.

Respecting this constructional arrangement makes it possible to optimize the retention of the foot P in the article of footwear, or boot, CH, which is provided by the inner tightening mechanism.

On the one hand, the tension in the retention band 1 exerts a horizontal component of force F2, F3. The forces F2, F3 generate a deformation of the upper O, especially in the area of the portions Ob, Oc, which are located between the anchoring points 22, 12, and the sole 100, respectively, to define tensioned positions of the portions Ob, Oc, of the upper. In view of the flexibility of the upper O, the upper portions Ob, Oc, become deformed inwardly, relative to non-tensioned positions, by coming closer to the foot P and by thus providing a lateral retention of the foot P.

On the other hand, the tension in the retention band 1 exerts a vertical, downward pressure F4 which, by means of the portion S1, vertically retains the foot P pressed against the sole 100.

The position of the anchoring points 12, 22 along the flexion fold-heel line L has a direct influence on the distribution between the lateral tightening and the vertical tightening of the foot. A position close to the sole 100 promotes the vertical tightening and the pressure F4. Conversely, a position close to the flexion fold 102 promotes the lateral retention by deformation of the upper portions Ob, Oc, under the effect of horizontal forces F2, F3. The best compromise was obtained for a position in the central portion 2 of the flexion fold-heel line L.

Of course, this position is only provided by way of example and is absolutely not limiting, since to each flexibility of the upper O, especially in the area of the portions Ob, Oc, corresponds a specific position with respect to Ob, Oc, for obtaining the desired tightening distribution.

To facilitate the loosening of the inner tightening mechanism, the retention band 1 advantageously includes a gripping arrangement 8 that is arranged on the portion S1 of the retention band 1. The gripping arrangement 8 can be a loop obtained in the form of a strap, for example, and fixed to the retention band 1 by appropriate means, such as a stitchings 8*a*.

Thus, to loosen the device, the user grabs the gripping arrangement 8 by hand and pulls substantially upward along an action F5.

This action F5 causes the retention band 1 to slide in the return 5, and thus lengthens the portion S1 of the band 1. The user then continues to pull on the gripping device 8 to free a space between the portion S1 and the flexion fold 102 of the foot P, which is necessary for the release of the foot P from the article of footwear CH.

For fitting a large sized foot P, the upper O can advantageously include a housing 30 on its inner surface Oa, in the area where the sliding return 5 is located. Thus, the return 5 becomes nested in the housing 30, avoiding constituting a hard spot on the foot P. Indeed, the return 5 is most often made of a rigid material, especially plastic.

Figure 4:
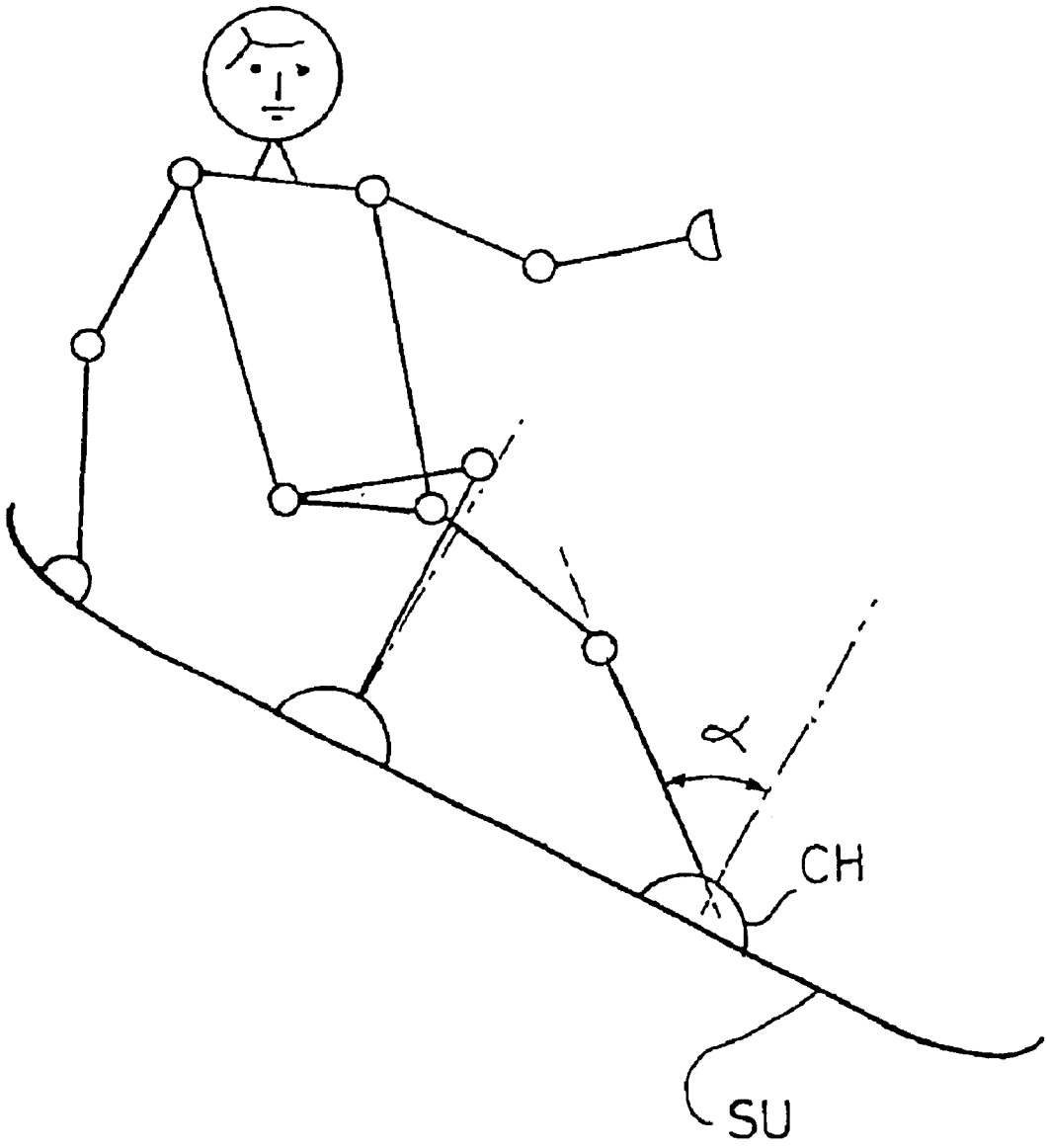
FIG. 4 schematically shows a front view of a user equipped with an article footwear connected to a gliding board such as a snowboard.

FIG. 4 schematically shows a snowboarder equipped with an article of footwear CH which is itself connected to the snowboard SU. FIG. 4 shows the specific forces applied to the article of footwear CH during snowboarding.

The foot which is positioned at the front of the snowboard S has a large angle $\alpha$ with respect to the perpendicular line, in relation to the snowboard S, which is located substantially in the axis of the snowboard S and on the medial side of the foot. Thus, the article of footwear CH must allow this movement while ensuring the retention and the comfort of the foot during the movement.

Figure 5:
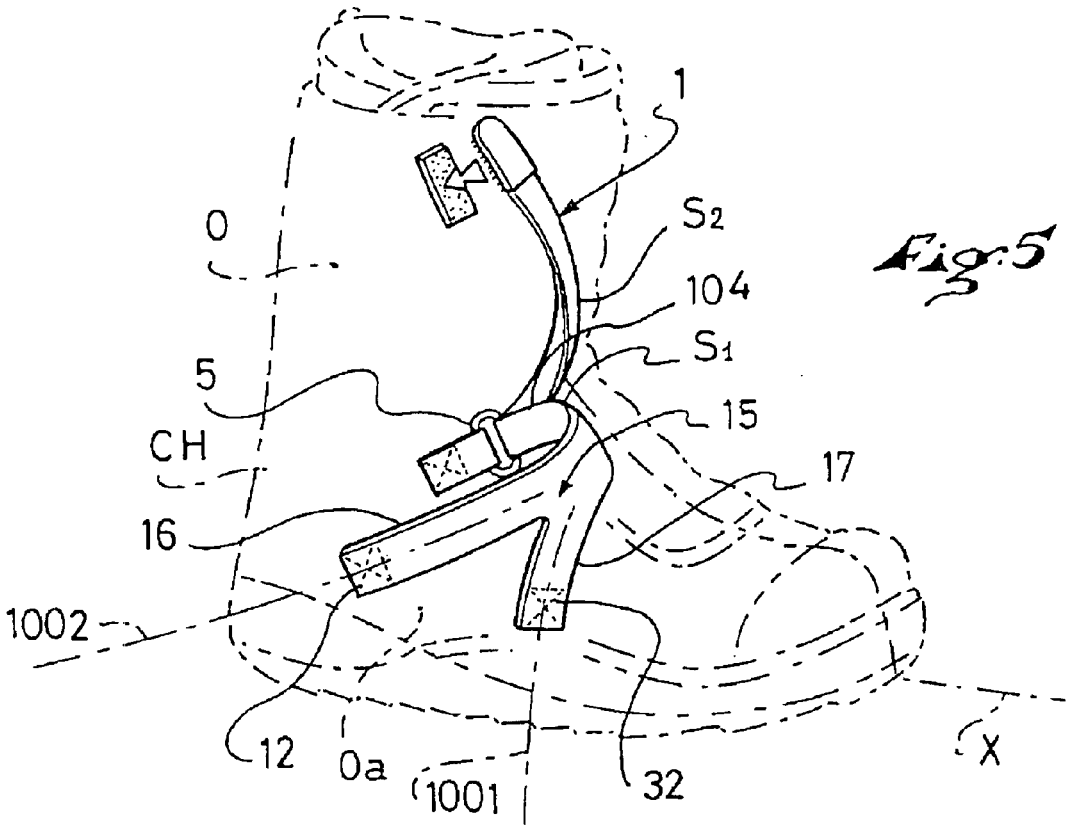
FIG. 5 schematically shows a perspective side view of a first alternative of the inner tightening mechanism according to the first embodiment.

FIG. 5 shows a variation of the tightening mechanism which, particularly but in a non-limiting fashion, makes it possible to meet the specific requirements of snowboarding.

The article of footwear CH, which includes the inner tightening mechanism, is shown in broken lines. This variation is different from the embodiment shown in FIGS. 1 and 3 essentially with respect to the portion S1 of the retention band 1, which surrounds the foot in the area of the flexion fold. The portion S2 of the band 1 as well as the means for fixing the portion S2 remain similar to the previous embodiments.

In this variation, the retention band 1 includes a fork 15 which comprises two arms 16, 17. The arm 16 integrates the anchoring point 12 which is consistent with the description of the embodiment shown in FIGS. 1 and 3. The arm 17 is fixed to the inner surface Oa of the upper O by a complementary anchoring point 32 that is positioned on the same side of the upper O as the anchoring point 12. The complementary anchoring point 32 can be obtained especially by sewing the arm 17 on the inner surface O. The arm 16 is positioned substantially along the primary direction 1002 which passes by the base of the heel and by the flexion fold of the foot. In addition, the arm 17 also passes by the flexion fold, but along a secondary direction 1001 that is less inclined than the primary direction 1002. The axial length 3 and the secondary direction 1001 are shown in FIG. 5 in broken lines.

However, the secondary direction 1001 remains inclined rearwardly, and the arms 16, 17 are fixed to the upper O on the medial side of the article of footwear CH.

Respecting this constructional arrangement makes it possible to retain the foot, in the area of the flexion fold, without exerting any localized excess pressure point on the medial side of the foot, especially in the area of the first cuneiform and carpal bones of the foot, which constitutes a protuberance on the inner surface of the foot. Indeed, the arm 16 passes above the bones whereas the arm 17 passes in front of them. The arms 16, 17 are joined by forming a fork 15 and are extended in the direction of the sliding return 5 by a single arm 104. The fork 15 is located substantially in the area of the flexion fold of the foot.

Therefore, the portion S1 of the retention band 1 can advantageously be obtained in a single piece including the single arm 104 and the arms 16, 17, also made of the same material. However, it can be interesting to use different materials for the arm 16 and the arm 17, especially with respect to the elasticity of the materials. To better adapt the geometry of the fork 15 to the foot of each user, and therefore to better distribute the pressures on the foot, one arm, especially the arm 17, can advantageously be made of a material that is more elastic than the constituent material of the other arm, especially the arm 16.

By way of a non-limiting example, interesting results in terms of comfort and holding of the foot have been obtained for a geometry such that the anchoring point 12 is arranged substantially at 7.5 cm from the heel and at 3.7 cm from the top of the sole, and the anchoring point 32 is arranged at 15.7 cm from the heel and at 2.5 cm from the. top of the sole.

Of course, other locations of the anchoring points 12, 32, remain consistent with the invention given that the location also depends on the geometry of the article of footwear CH, especially with respect to the flexion fold.

Figure 6:
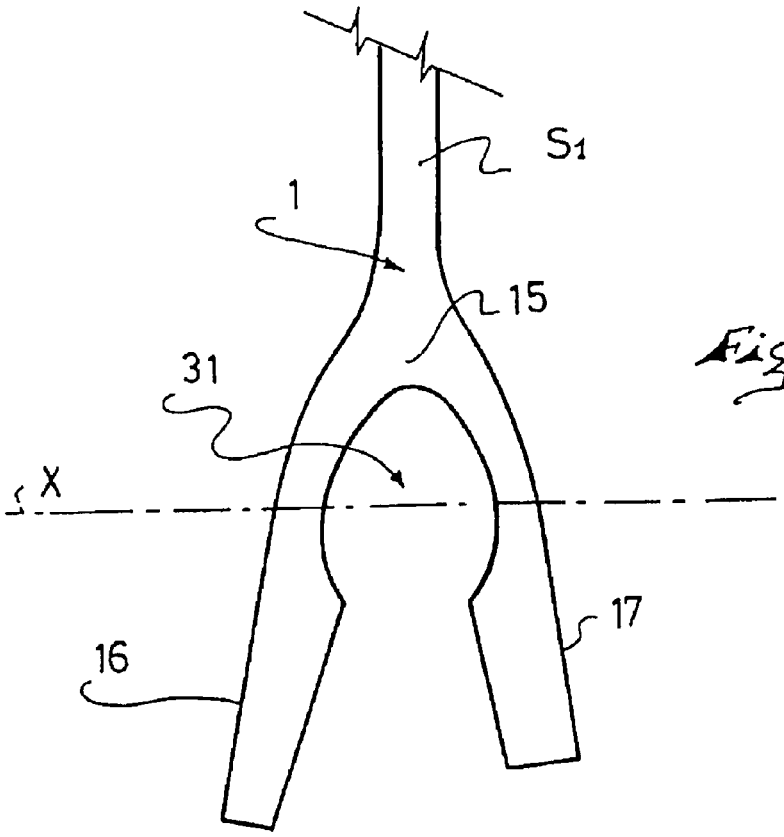
FIG. 6 schematically shows a top view of the retention band according to the alternative embodiment shown in FIG. 5.

FIG. 6 shows an alternative embodiment of the fork 15 shown in the previous figure. The retention band 1 includes, in its position S1 which covers the foot P. the fork 15 that is divided into two arms 16, 17 as described previously. However, the fork 15 is positioned beyond the longitudinal axis X of the article of footwear and on the side of the sliding return. Thus, the retention band 1 includes a recess 31 arranged at the junction of the two arms 16, 17 and of the fork 15. This recess 31 is advantageously centered around the longitudinal axis X. This position, which places the recess 31 in the area of the flexion fold of the foot, makes it possible to increase the comfort of the foot during forward axial bendings. Indeed, during these biases, the recess 31 enables a deformation by bending of the fork 15 which comes closer to the arms 16, 17. In most sporting activities using an article of footwear having a flexible or semi-rigid upper which can be equipped with the present inner tightening mechanism, the article of footwear is subject to bendings in the longitudinal plane passing by X, especially toward the front. However, during bendings of this type, the portion S1 of the retention band 1 applies pressures in the area of the flexion fold of the foot, which can possibly prove painful for certain sensitive feet. This is why the following figures show improvements or alternative embodiments making it possible to improve the comfort in the area of the flexion fold of the foot.

Figure 7:
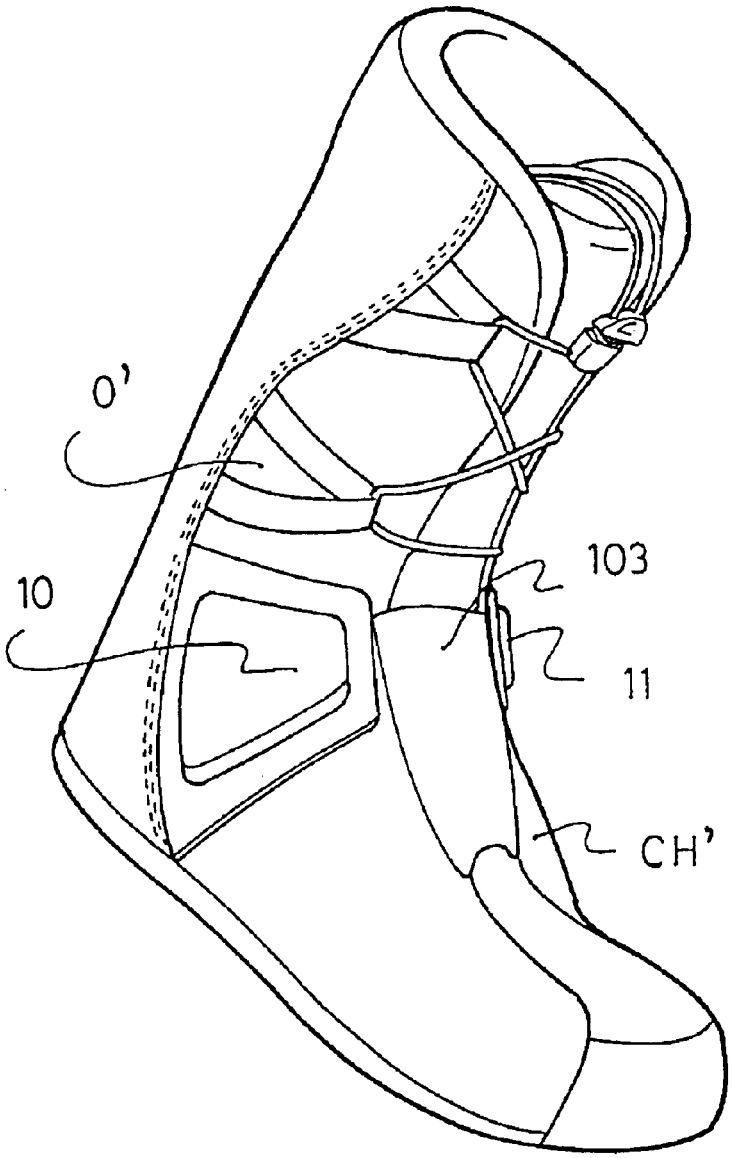
FIG. 7 schematically shows a perspective side view of the inner shoe or boot equipping the article of footwear which has the inner tightening mechanism according to the first embodiment.

In FIG. 7, the inner shoe or boot CH', with which the previously shown footwear is equipped, forms an envelope around the foot, between the foot and the inner tightening mechanism which is on the outer upper. The inner shoe CH' includes at least two raised elements 10, 11, which are fixed on the lateral side and on the medial side, respectively, of the inner shoe CH'. In addition, the raised elements 10, 11, are arranged such that the portion S1 of the retention band, previously designated by the reference numeral 1, takes support especially on the raised elements 10, 11, without exerting excessive pressures on the top 103 of the inner shoe CH', in the area of the flexion fold.

The raised elements 10, 11 are fixed outside the upper O' of the inner shoe CH', substantially along the axial length comprised between the flexion fold and the heel of the foot. These elements 10, 11, have an excess thickness with respect to the remainder of the of the upper O' of the inner shoe CH'. Thus, the retention band, by taking support on the raised elements 10, 11, moves away from the inner shoe CH', especially on the top 103, and thus exerts less pressure in the area of the flexion fold 102.

The raised elements 10, 11, which could advantageously be made of foam, have an excess thickness comprised between 5 and 20 millimeters, and can be arranged sufficiently close to the top 103 of the inner shoe CH'.

Figure 8:
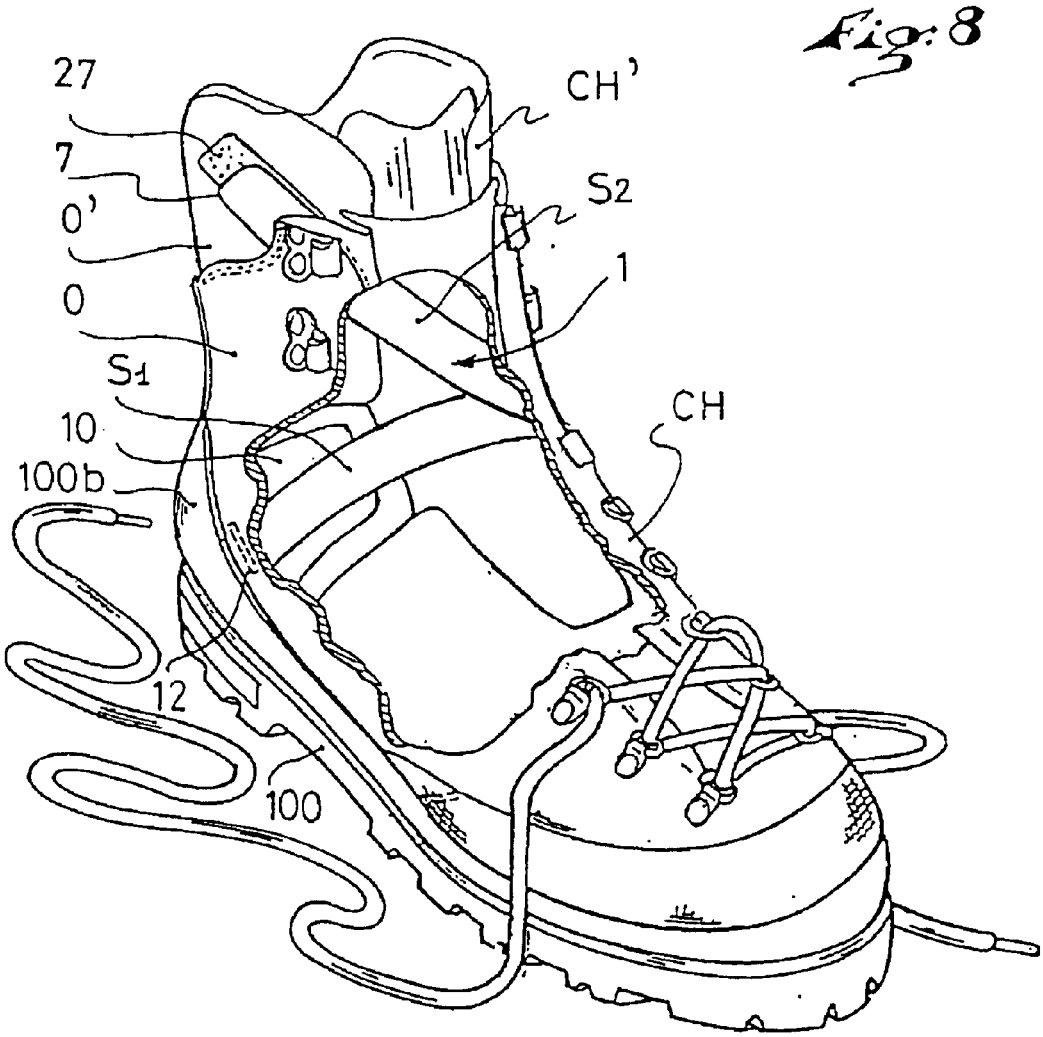
FIG. 8 schematically shows a perspective front view of an article of footwear whose upper is broken-away, showing the inner shoe/boot, the inner tightening mechanism according to the first embodiment.

In FIG. 8, the article of footwear CH shown is a mounting hiking boot, and especially in cold weather, for it is equipped with a removable inner shoe CH' which includes an upper O'. Additionally, the upper O' of the inner shoe CH' includes a fastening arrangement 27 that is complementary to the fastening arrangement 7, itself positioned on the portion S2 of the retention band 1. The fastening arrangement 27 can advantageously be positioned on the top portion of the upper O' and on its lateral side. Thus, to tighten the inner tightening mechanism, the user exerts a force oriented upward and outward of the foot. Similarly, the anchoring point, which includes the previously described sliding return, is positioned on the medial side of the article of footwear CH. The fastening arrangements 27, 7 are advantageously of the self-gripping type. In addition, the anchoring points 12 are advantageously obtained by seams on the upper O of the boot CH. The boot CH currently shown includes a sole 100 overlaid by an element 100*b* made of a rigid material for it is adapted to cooperate with cleats. Thus, at least one anchoring point 12 is positioned on the flexible or semi-rigid upper O and, therefore, above the rigid support element 100*b*.

FIG. 8 also shows a retention band 1 that takes support, in the area of its portion S1, on the inner shoe CH', in the area of the raised element 10.

Figure 9:
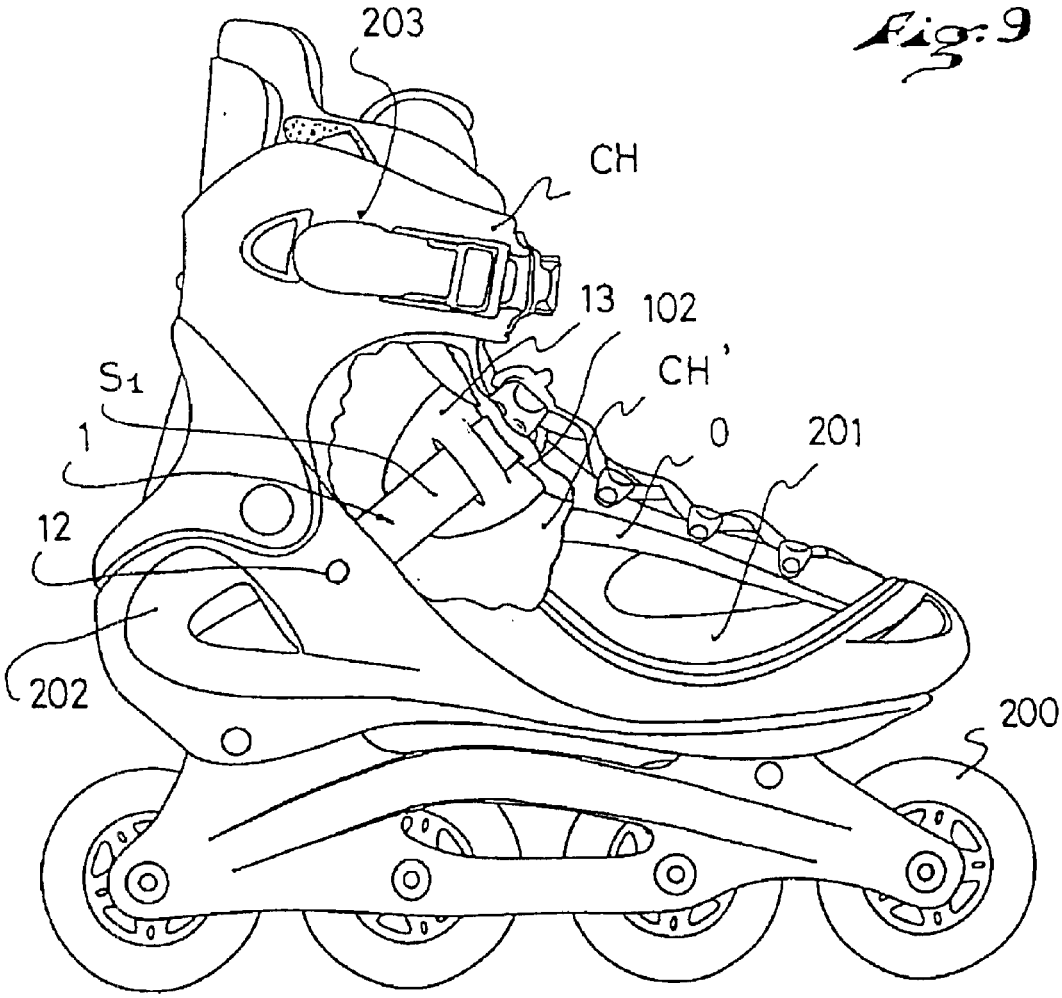
FIG. 9 schematically shows a side view of an article of footwear that is affixed to a gliding apparatus, and whose upper is broken-away, that shows the inner tightening mechanism according to a second alternative of the first embodiment.

In FIG. 9, the article of footwear CH shown is an in-line roller skate including a rolling device 200. The article of footwear CH includes an inner shoe CH' which is visible in the figure by means of a portion of the upper O of the article of footwear CH being broken away for convenience. The upper O here is constituted of a flexible envelope 201, arranged especially in the area of the instep, which is coupled here to rigid reinforcing elements 202, 203. These reinforcing elements 202, 203 are respectively connected to the rolling device 200 and make it possible to stabilize the ankle laterally. Therefore, the upper O is indeed an upper of the semi-rigid type as previously defined.

In this embodiment, the inner tightening mechanism includes at least one distribution plate 13 that is fixed beneath the retention band 1, in the area of the portion S1. The distribution plate 13 is positioned substantially in the area of the flexion fold 102 and between the inner shoe CH' and the upper O of the article of footwear CH. This distribution plate 13, which can advantageously be made of a thermoplastic material, makes it possible to distribute, on the top of the inner shoe CH', the pressure exerted by the portion S1 of the retention band 1. The means here for locking the tension in the inner tightening mechanism is of the same type as that previously mentioned.

However, the point 12 for anchoring the retention band 1 on the upper O, fixed in the rigid reinforcement 202, can advantageously be obtained by means of a rivet.

Figure 10:
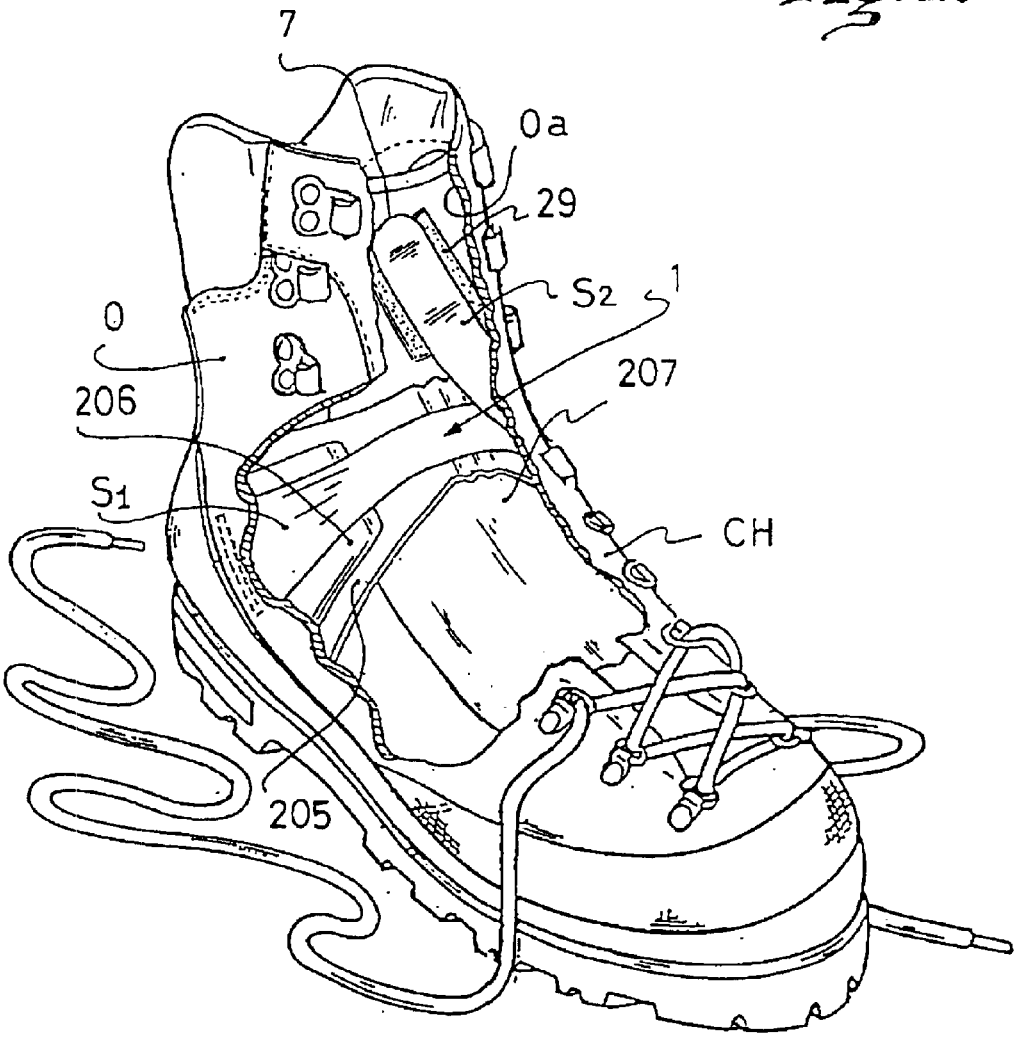
FIG. 10 schematically shows a perspective front view of an article of footwear whose upper is broken-away showing the inner tightening mechanism according to the second embodiment.

In FIG. 10, the article of footwear CH shown is a walking boot having a flexible or semi-rigid upper O. The article of footwear CH includes, within its upper O, an inner envelope 205 that is positioned laterally between the flexion fold and the heel. The envelope 205 is also positioned beneath the portion S1 of the retention band 1 of the inner tightening mechanism. To improve the comfort, the envelope 205 includes at least one raised element 206 that is positioned along the axial length as defined previously. This raised element 206 has an excess thickness with respect to the envelope 205 and in the direction of the upper O. In addition, the portion S1 of the retention band 1 is positioned on the raised element 206 so as to distribute the tightening pressure of the inner tightening mechanism, and to avoid the excess pressures on the foot in the area of the flexion fold.

The tension is maintained in the retention band 1 by a fastening arrangement 29 that is arranged on the inner surface Oa of the upper O of the article of footwear CH and which is complementary to the fastening arrangement 7 arranged on the portion S2 of the retention band 1. In the preferred embodiment shown in FIG. 10, the article of footwear CH has a tongue 207, and the fastening arrangement 29 is arranged on the tongue 207, thus being inserted between the tongue 207 and the upper O. The tongue 207, which is positioned beneath the envelope 205, also makes it possible to dissipate the excess pressures generated by the inner tightening mechanism on the foot.

Another alternative embodiment, not shown, includes positioning, on the portion S1 of the retention band 1, a fastening arrangement that is complementary to the that is arranged on the portion S2 of the retention band 1. This he fastening arrangement makes it possible to maintain the retention band 1.

Of course, the present invention is not limited to the embodiments described hereinabove, which are provided for guidance only, but encompasses all similar or equivalent embodiments. The present invention also includes the article of footwear equipped with the tightening mechanism.

What is claimed is:

1. An inner tightening mechanism adapted to equip an article of footwear having a flexible or semi-rigid upper mounted on a sole, said tightening mechanism comprising:

a single retention band connected to the inner surface of the upper between two anchoring points fixed on lateral and medial sides, respectively, of the upper, said single retention band adapted to partially surround a foot of a wearer of the article of footwear in a flexion fold area and extending from said flexion fold area in a direction, along a length of said retention band, to an area adapted to receive a heel of the foot.

2. An inner tightening mechanism according to claim 1, wherein at least one of said anchoring points is positioned substantially above the sole.

3. An inner tightening mechanism according to claim 2, wherein at least one of said anchoring points is positioned substantially on a central portion of a line connecting a base of the heel to the flexion fold of the foot.

4. An inner tightening mechanism adapted to equip an article of footwear having a flexible or semi-rigid upper mounted on a sole, said tightening mechanism comprising:

a retention band connected to the inner surface of the upper by at least two anchoring points fixed on lateral and medial sides, respectively, of the upper, at least a portion of said retention band adapted to partially surround a foot of a wearer of the article of footwear in a flexion fold area and extending from said flexion fold area in a direction, along a length of said retention band, to an area adapted to receive a heel of the foot;

one of said anchoring points including a sliding return; and the retention band being fixed at an end to a second of said anchoring points, the retention band passing in the sliding return by defining a portion which covers the foot.

5. An inner tightening mechanism according to claim 1, wherein the retention band includes a fork comprising two arms, one of said arms integrating one of said anchoring points, and a second of said arms is fixed on an inner surface of the upper by a complementary anchoring point that is positioned on the same side of the upper as the first anchoring point.

6. An inner tightening mechanism according to claim 1, wherein a second portion of the retention band, which is comprised between a sliding return and an end of the retention band, includes a fastening arrangement capable of maintaining tension in the tightening mechanism.

7. An inner tightening mechanism according to claim 6, wherein the article of footwear is equipped with an inner shoe having an upper, said attachment mechanism constitutes a first attachment mechanism, and an upper of the inner shoe includes a second attachment mechanism that is complementary to the first attachment mechanism.

8. An inner tightening mechanism according to claim 6, wherein one of said anchoring points includes a sliding return, and the retention band, which is fixed at an end to a second of said anchoring points, passes in the sliding return by defining a portion which covers the foot, and wherein the portion of the retention band includes an attachment mechanism means that is complementary to the previously cited attachment mechanism.

9. An inner tightening mechanism according to claim 6, wherein the inner surface of the upper includes a fastening arrangement that is complementary to the fastening arrangement of the second portion of the retention band.

10. An inner tightening mechanism according to claim 6, wherein said fastening arrangement is a self-gripping type.

11. An inner tightening mechanism according to claim 1, wherein one of said anchoring points includes a sliding return, and the retention band, which is fixed at an end to a second of said anchoring points, passes in the sliding return by defining a portion which covers the foot, and wherein the retention band includes a gripping arrangement that is arranged on said portion and which enables the loosening of the inner tightening mechanism.

12. An inner tightening mechanism according to claim 1, wherein the article of footwear is equipped with an inner shoe which includes at least two raised elements that are fixed on the lateral side and on the medial side, respectively, of the inner shoe, and wherein the retention band is supported on the raising elements.

13. An inner tightening mechanism according to claim 1, wherein one of said anchoring points includes a sliding return, and the retention band, which is fixed at an end to a second of said anchoring points, passes in the sliding return by defining a portion which covers the foot, and wherein the retention band includes at least one distribution plate fixed in the area of the portion, beneath the retention band.

14. An inner tightening mechanism according to claim 5, wherein one of the arms is positioned substantially along a primary direction that passes by the base of the heel and by the flexion fold, and wherein another of the arms also passes by the flexion fold but along a secondary direction that is less inclined than the primary direction.

15. An inner tightening mechanism according to claim 14, wherein the arms are fixed to the upper on the medial side of the article of footwear.

16. An inner tightening mechanism according to claim 4, wherein the anchoring point which includes the sliding return is positioned on the medial side of the article of footwear.

17. An inner tightening mechanism according to claim 4, wherein the upper includes a housing on the inner surface, in an area where the sliding return is located.

18. An article of footwear comprising:

a sole;

an upper mounted on said sole, said upper having a lateral side, a medial side, and an inner surface, said upper being flexible or semi-rigid;

an inner tightening mechanism for retention of a foot in position within said article of footwear, said inner tightening mechanism comprising:

a retention band fixed with respect to said inner surface of said upper at at least two anchoring points, a first of said anchoring points being on said lateral side of said upper and a second of said anchoring points being on said medial side of said upper, at least a portion of said retention band at least adapted to partially surround a foot of a wearer of the boot in a flexion fold area and extending in a direction, along a length of said retention band, to an area adapted to receive a heel of the foot.

19. An article of footwear according to claim 18, further comprising an inner shoe, said inner shoe including at least two raised elements, a first of said raised elements being fixed on a lateral side of said inner shoe and a second of said raised elements being fixed on a medial side of said inner shoe, said retention band taking support on said raised elements.

20. An article of footwear comprising:

a soles;

an upper mounted on said sole, said upper having a lateral side, a medial side, and an inner surface, said upper being non-rigid;

an inner tightening mechanism for retention of a foot in position within said article of footwear, said inner tightening mechanism comprising:

a retention band fixed with respect to said inner surface of said upper at least two anchoring points, a first of said anchoring points being on said lateral side of said upper and a second of said anchoring points being on said medial side of said upper, at least a portion of said retention band at least adapted to partially surround a foot of a wearer of the boot in a flexion fold area and extending in a direction, along a length of said retention band, to an area adapted to receive a heel of the foot.

21. An article of footwear according to claim 18, wherein each of said lateral and medial sides of said upper includes a respective portion having a tensioned position and a non-tensioned position, said tensioned positions of said lateral and medial sides of said upper being inward toward the foot of the wearer relative to said non-tensioned positions of said lateral and medial sides of said upper.

22. An article of footwear according to claim 18, wherein said inner tightening mechanism further comprises a sliding return, wherein said retention band further comprises an end and a second portion, said second portion of said retention band extending between said sliding return and said end of said retention band, said inner tightening mechanism further comprising a fixing device carried by said second portion of said retention band for maintaining tensioning in said inner tightening mechanism.

23. An article of footwear according to claim 22, wherein said article of footwear further comprises an inner shoe having an upper, wherein said fixing device carried by said second portion of said retention band constitutes a first fixing device, and wherein said upper of said inner shoe includes a second fixing device complementary to said first fixing device.

24. An article of footwear according to claim 22, wherein one of said anchoring points includes a sliding return, and the retention band, which is fixed at an end to a second of said anchoring points, passes in the sliding return by defining a portion which covers the foot, and wherein the portion of the retention band includes an attachment mechanism means that is complementary to the previously cited attachment mechanism.

25. An article of footwear according to claim 22, wherein the inner surface of the upper includes a fixing device that is complementary to the fixing device of the second portion of the retention band.

26. An article of footwear according to claim 22, wherein said fixing device is a self-gripping type.

27. An article of footwear according to claim 18, wherein at least one of said anchoring points is spaced above said sole.

28. An article of footwear according to claim 18, wherein both of said two anchoring points are spaced above said sole.

29. An article of footwear according to claim 24, wherein at least one of said two anchoring points is positioned substantially along a central portion of a line connecting a base of the heel of the wearer to the flexion fold of the foot of the wearer.

30. An article of footwear according to claim 18, wherein one of said two anchoring points includes a sliding return, and wherein said retention band, which is fixed at an end to a second of said anchoring points, passes in said sliding return by defining a portion which covers the foot of the wearer.

31. An article of footwear according to claim 30, wherein said one of said two anchoring points which includes said sliding return is positioned on said medial side of said upper.

32. An article of footwear according to claim 30, wherein said upper includes a housing on said inner surface, in an area where said sliding return is located.

33. An article of footwear according to claim 18, wherein said retention band includes a fork comprising two arms, one of said arms integrating one of said anchoring points, and wherein a second of said arms is fixed on an inner surface of said upper by a complementary anchoring point positioned on the same side of the upper as said first anchoring point.

34. An article of footwear according to claim 33, wherein one of said arms of said fork is positioned substantially along a primary direction passing through a base of the heel and through the flexion fold of the foot of the wearer, and wherein another of said arms also passes through the flexion fold of the foot of the wearer but along a secondary direction, said secondary direction being inclined along a horizontal plane less than said primary direction.

35. An article of footwear according to claim 34, wherein said arms of said fork are fixed to said medial side of said upper.

36. An article of footwear according to claim 18, wherein one of said two anchoring points includes a sliding return, wherein said retention band, which is fixed at an end to a second of said anchoring points, passes in said sliding return by defining a portion which covers the foot of the wearer, and wherein said retention band includes a gripping device arranged on said portion of said retention band, said gripping device enabling loosening of said inner tightening mechanism.

37. An article of footwear according to claim 18, wherein one of said two anchoring points includes a sliding return, wherein said retention band, which is fixed at an end to a second of said anchoring points, passes in said sliding return by defining a portion which covers the foot of the wearer, and wherein said inner tightening mechanism further includes at least one distribution plate fixed in an area of said portion of said retention band, beneath said portion of said retention band.

38. An article of footwear comprising:

a sole;

an upper mounted on said sole, said upper having an inner surface and two sides, said two sides being constituted by a lateral side and a medial side;

a tightening mechanism for retention of a foot of a wearer in position within said article of footwear by means of said tightening mechanism applying at least a downwardly directed force upon the foot toward said sole and sidewardly directed forces upon the foot at said lateral and medial sides of said upper, said tightening mechanism comprising:

a retention band including a portion fixed with respect to said inner surface of said upper at an anchoring point at one of said two sides of said upper, said portion of said retention band extending from said anchoring point, across a top of the foot of a wearer, to a second of said two sides of said upper, said portion of said retention band being positioned along a plane extending substantially through a flexion fold area of the foot of a wearer, through said anchoring point, and through an area adapted to receive a heel of the foot of a wearer, said upper having a flexibility whereby, upon tightening of the foot within the upper, said two sides of said upper are inwardly deformed.

39. An article of footwear according to claim 38, further comprising an inner boot positioned beneath said upper and beneath said tightening mechanism.

40. An article of footwear according to claim 38, wherein said upper is flexible.

41. An article of footwear according to claim 38, wherein each of said lateral and medial sides of said upper includes a respective portion having a tensioned position and a non-tensioned position, said tensioned positions of said lateral and medial sides of said upper being inward toward the foot of the wearer relative to said non-tensioned positions of said lateral and medial sides of said upper.

42. An article of footwear according to claim 38, wherein said tightening mechanism further comprises a sliding return, said sliding return fixed to said inner surface of said upper at a second of said two sides of said upper at a second anchoring point, and wherein said retention band passes in said sliding return and extends upwardly from said sliding return to thereby provide access to said retention band to have said downwardly and sidewardly directed forces applied.

43. An article of footwear according to claim 42, wherein at least one of said anchoring points is spaced above said sole.

44. An article of footwear according to claim 42, wherein both of said anchoring points are spaced above said sole.

45. An article of footwear according to claim 42, wherein both of said anchoring points are positioned substantially at a center of a line connecting a base of the heel of the wearer to the flexion fold of the foot of the wearer.

46. An inner tightening mechanism according to claim 1, wherein said portion of said retention band is adapted to extend over a foot of a wearer of the boot in said flexion fold area.

47. An inner tightening mechanism according to claim 1, wherein said upper is sufficiently flexible so that, upon tightening of the foot within the upper, said two sides of said upper are inwardly deformed.

48. An inner tightening mechanism according to claim 1, wherein said retention band extends from one of said two anchoring points upwardly to a fastening arrangement to be removably affixed to an area of said upper forward of an area of said upper adapted to receive a lower leg of the wearer.

49. An article of footwear according to claim 18, wherein said portion of said retention band is adapted to extend over a foot of a wearer of the boot in said flexion fold area.

50. An article of footwear according to claim 18, wherein said upper is sufficiently flexible so that, upon tightening of the foot within the upper, said two sides of said upper are inwardly deformed.

51. An article of footwear according to claim 18, wherein said retention band further extends from said second of said anchoring points upwardly to a fastening arrangement to be removably affixed to an area of said upper forward of an area of said upper adapted to receive a lower leg of the wearer.

52. An article of footwear according to claim 38, wherein said retention band further extends from said second of said two sides of said upper upwardly to a fastening arrangement to be removably affixed to an area of said upper forward of an area of said upper adapted to receive a lower leg of the wearer.

53. An inner tightening mechanism according to claim 4, wherein said retention band is a single retention band connected to the inner surface of the upper between the two anchoring points fixed on the lateral and medial sides, respectively, of the upper.

54. An article of footwear according to claim 18, wherein said retention band is a single retention band connected to and extending between said inner surface of said upper at said two anchoring points.

* * * * *